US010677131B2

(12) United States Patent
Meier et al.

(10) Patent No.: US 10,677,131 B2
(45) Date of Patent: Jun. 9, 2020

(54) METHOD FOR DETERMINING A TEMPERATURE OF A DIAPHRAGM OF A PUMP

(71) Applicant: CONTINENTAL AUTOMOTIVE GMBH, Hannover (DE)

(72) Inventors: Thomas Meier, Regensburg (DE); Bhagespur Naveen, Bangalore (IN); Udaya Peruvaje, Kamataka (IN); Thomas Schön, Parsberg (DE); Vivek Venkobarao, Bangalore (IN)

(73) Assignee: Vitesco Technologies GmbH, Hannover (DE)

( * ) Notice: Subject to any disclaimer, the term of this patent is extended or adjusted under 35 U.S.C. 154(b) by 0 days.

(21) Appl. No.: 15/730,024

(22) Filed: Oct. 11, 2017

(65) Prior Publication Data

US 2018/0030873 A1 Feb. 1, 2018

Related U.S. Application Data

(63) Continuation of application No. PCT/EP2016/058078, filed on Apr. 13, 2016.

(30) Foreign Application Priority Data

Apr. 14, 2015 (DE) ..... 10 2015 206 589

(51) Int. Cl.
*F04B 43/02* (2006.01)
*F01N 3/20* (2006.01)
(Continued)

(52) U.S. Cl.
CPC ..... *F01N 3/208* (2013.01); *F04B 23/025* (2013.01); *F04B 43/02* (2013.01); *F04B 43/04* (2013.01);
(Continued)

(58) Field of Classification Search
CPC ..... F01N 3/208; F04B 23/025; F04B 43/02; F04B 49/065
(Continued)

(56) References Cited

U.S. PATENT DOCUMENTS 3,766,536 A * 10/1973 Hile
5,605,133 A * 2/1997 Tuckey
(Continued)

FOREIGN PATENT DOCUMENTS

CN 101495754 A 7/2009
CN 103573508 A 2/2014
(Continued)

OTHER PUBLICATIONS

International Search Report and Written Opinion dated Jul. 19, 2016 from corresponding International Patent Application No. PCT/EP2016/058078.
(Continued)

*Primary Examiner* — Kawing Chan

(57) ABSTRACT

A method for determining a temperature of a diaphragm of a pump, the pump pumping a fluid out of a tank to a dispersion point by way of a movement of the diaphragm, the pump being fastened to the tank, the temperature of the diaphragm being estimated in a manner which is at least dependent on the temperature of the fluid in the tank.

16 Claims, 3 Drawing Sheets

(51) Int. Cl.
*F04B 23/02* (2006.01)
*F04B 49/06* (2006.01)
*F04B 43/04* (2006.01)

(52) U.S. Cl.
CPC ..... *F04B 49/065* (2013.01); *F01N 2610/02* (2013.01); *F04B 2205/10* (2013.01); *F04B 2205/11* (2013.01)

(58) Field of Classification Search
USPC ..... 318/471
See application file for complete search history.

(56) References Cited

U.S. PATENT DOCUMENTS

| | | | | |
|---|---|---|---|---|
| 5,704,520 | A | 1/1998 | Gross | |
| 5,941,086 | A * | 8/1999 | Petrulio | F25B 41/062 236/68 R |
| 6,519,935 | B2 * | 2/2003 | Weigl | |
| 6,769,248 | B2 * | 8/2004 | Giberson | |
| 9,719,396 | B2 * | 8/2017 | Bruck | |
| 10,231,357 | B2 * | 3/2019 | Chainer | H05K 7/20354 |
| 2004/0055363 | A1 * | 3/2004 | Bristol | F04B 49/20 73/31.03 |
| 2008/0283550 | A1 | 11/2008 | Nighy et al. | |
| 2010/0016764 | A1 * | 1/2010 | Lacoste | A61N 7/02 601/2 |
| 2011/0047972 | A1 * | 3/2011 | Bauer | B01D 53/90 60/274 |
| 2011/0107817 | A1 * | 5/2011 | Krauss | G01N 15/0656 73/25.03 |
| 2012/0217894 | A1 | 8/2012 | Chang et al. | |
| 2013/0004340 | A1 | 1/2013 | Gonnella et al. | |
| 2014/0026857 | A1 | 1/2014 | Tsutsui et al. | |
| 2014/0166596 | A1 * | 6/2014 | Anderson | F02M 37/24 210/799 |
| 2014/0210392 | A1 | 7/2014 | Berry et al. | |
| 2015/0083756 | A1 | 3/2015 | Ciavarella et al. | |
| 2015/0314058 | A1 | 11/2015 | O'Mahony | |
| 2016/0003251 | A1 | 1/2016 | Nonomura et al. | |
| 2016/0107111 | A1 * | 4/2016 | Boodaghians | |
| 2016/0131005 | A1 * | 5/2016 | Bruck | |
| 2017/0299622 | A1 * | 10/2017 | Schoen | B81B 3/0081 |
| 2018/0030873 | A1 * | 2/2018 | Meier | |

FOREIGN PATENT DOCUMENTS

| | | | |
|---|---|---|---|
| CN | 103967871 | A | 8/2014 |
| CN | 104114865 | A | 10/2014 |
| CN | 104363935 | A | 2/2015 |
| DE | 602005003106 | | 8/2008 |
| DE | 102014100893 | A1 | 7/2014 |
| DE | 102013105712 | A1 | 12/2014 |
| FR | 482111 | A | 2/1917 |
| GB | 2316137 | A | 2/1998 |
| JP | 01147149 | A * | 6/1989 |
| JP | 2010209851 | A | 9/2010 |
| JP | 2012217894 | A | 11/2012 |

OTHER PUBLICATIONS

German Office Action dated Feb. 24, 2016 for corresponding German Patent Application No. 10 2015 206 589.8.
China Office Action dated Sep. 10, 2018 for corresponding Chinese Patent Application No. 201680021820.6.
Korean Office Action dated Nov. 29, 2018 for corresponding Korean Patent Application No. 10-2017-7029363.

* cited by examiner

METHOD FOR DETERMINING A TEMPERATURE OF A DIAPHRAGM OF A PUMP

CROSS-REFERENCE TO RELATED APPLICATIONS

This application claims the benefit of PCT Application PCT/EP2016/058078, filed Apr. 13, 2016, which claims priority to German Application DE 10 2015 206 589.8, filed Apr. 14, 2015. The disclosures of the above applications are incorporated herein by reference.

FIELD OF THE INVENTION

The invention relates to a method for determining a temperature of a diaphragm of a pump.

BACKGROUND OF THE INVENTION

Diaphragm pumps are known in the prior art which, for example, deliver a reducing agent from a tank to a catalytic converter with the aid of a diaphragm. It is important for a precise method of operation of the pump to know the temperature of the diaphragm. To this end, temperature sensors are used in the prior art.

SUMMARY OF THE INVENTION

It is the object of the invention to provide a simpler method for estimating the temperature of the diaphragm of the pump.

The object of the invention is achieved by way of the method as claimed in patent claim 1 and by way of the control unit as claimed in patent claim 10.

Advantageous embodiments of the method which is described are specified in the dependent claims.

One advantage of the method which is described consists in that the temperature of the diaphragm does not have to be measured, but rather may be estimated on the basis of available measured data. In this way, a temperature sensor for the diaphragm may be dispensed with. In addition, a detection and evaluation of the sensor signal are not required. This is achieved by virtue of the fact that the temperature of the diaphragm is estimated in a manner which is dependent on the temperature of the fluid in the tank. The temperature of the fluid which is delivered by the pump is suitable for an estimation of the temperature of the diaphragm, since the temperature of the fluid may influence the temperature of the diaphragm to a relatively pronounced extent.

In one embodiment of the method, the temperature of the diaphragm is estimated in a manner which is dependent on the temperature of the housing of the pump. The temperature of the housing of the pump also has an influence on the temperature of the diaphragm, and may therefore be used for an estimation of the temperature of the diaphragm. As a result, the estimation of the temperature of the diaphragm is refined further.

In a further embodiment, the temperature of the diaphragm is estimated in a manner which is dependent on the temperature in the space in which the pump is situated. The temperature of the space also has an influence on the temperature of the diaphragm. In this way, a further refinement of the estimation of the temperature of the diaphragm is achieved.

In a further embodiment, the temperature of the diaphragm is estimated in a manner which is dependent on the quantity of fluid which is pumped by the pump. In this way, a further refinement of the estimation of the temperature of the diaphragm is achieved, since the fluid supplies heat to the diaphragm or dissipates it from the diaphragm.

In a further embodiment, the temperature of the diaphragm is estimated in a manner which is dependent on a generation of heat of a drive, the drive being provided to actuate the diaphragm. In this way, the influence of the drive on the temperature of the diaphragm may also be used in order to achieve a further refinement of the estimation of the temperature of the diaphragm.

In a further embodiment, the temperature of the diaphragm after a downtime of the pump is assigned different start values during the estimation in a manner which is dependent on the duration of the downtime. Here, in the case of a relatively short downtime, the temperature of the diaphragm is fixed during the start to a value which was most recently estimated and stored for the temperature of the diaphragm.

In the case of a relatively long downtime of the pump, the temperature of the diaphragm is set during the start at the same level as the temperature of the space in which the pump is situated. In this way, a more rapid refinement of the estimation of the temperature of the diaphragm is achieved by way of the method which is described.

In a further embodiment, the pump is provided to deliver a reducing agent to a catalytic converter. During the metering of a reducing agent to a catalytic converter, in particular, a precise method of operation of the pump and precise metering of the reducing agent are advantageous.

In a further embodiment, the estimated temperature of the diaphragm is used to determine, in particular to correct, a quantity of fluid which is discharged by the pump. In this way, a refinement of the quantity of fluid which is actually dispensed by the pump is achieved.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

In the following text, the invention will be described in greater detail using the figures, in which.

DETAILED DESCRIPTION OF THE PREFERRED EMBODIMENTS

The following description of the preferred embodiment(s) is merely exemplary in nature and is in no way intended to limit the invention, its application, or uses.

Figure 1:
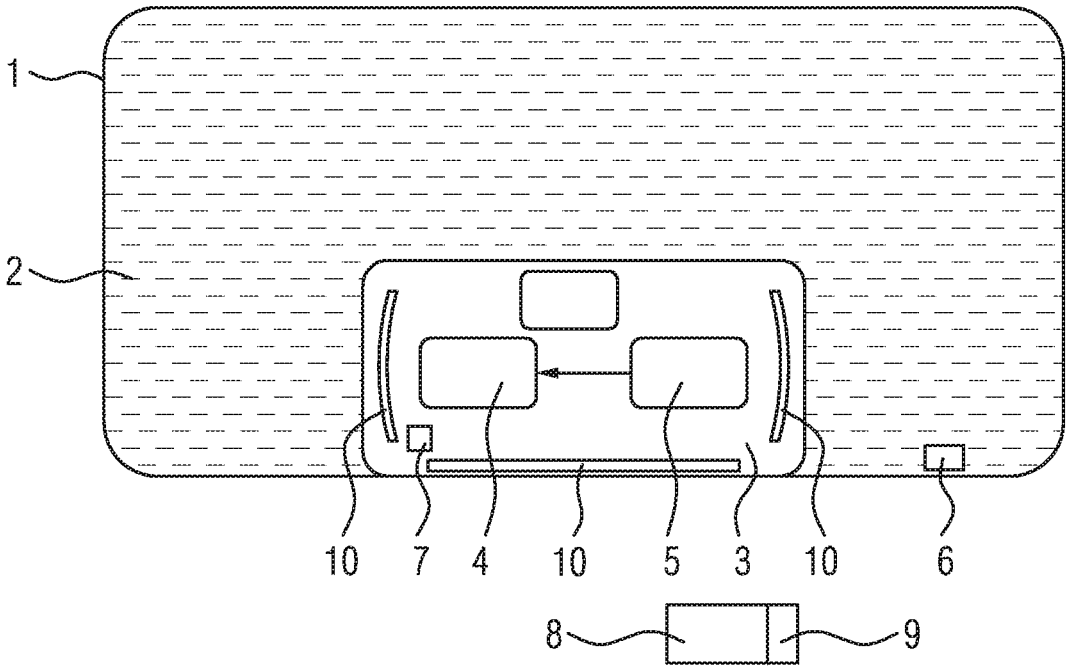
FIG. 1 shows a diagrammatic illustration of a tank with a pump.

FIG. 1 shows a diagrammatic illustration of a tank 1 in which a fluid is situated, for example in the form of a reducing agent 2. The reducing agent 2 may be, for example, a solution of 32.5% urea in water. Furthermore, the tank 1 has a space 3. The space 3 is configured at least in a manner which adjoins the tank 1 on an outer side of the tank 1. For example, the space 3 may be configured in the form of an indentation of the tank 1. A pump 4 is provided in the space 3. The pump 4 is connected via an intake region to the tank 1. Via the intake region, the pump 4 sucks reducing agent from the tank 1 and delivers the reducing agent to a dispensing point. The dispensing point may be, for example, a reduction catalytic converter of an internal combustion engine. For example, the internal combustion engine may be arranged in a vehicle.

The pump 4 is driven with the aid of a drive in the form of an electric motor 5. Furthermore, a first sensor 6 is provided for detecting the temperature of the reducing agent 2 in the tank 1. In addition, a second sensor 7 is provided in the space 3, which second sensor 7 detects the temperature in the space 3. The first and the second sensor 6, 7 are connected to a control unit 8 which has a data memory 9. In addition, the control unit 8 is connected via a control line (not shown) to the motor 5 of the pump 4. The control unit 8 is configured to actuate the motor 5 in a manner which is dependent on a predefined setpoint quantity of reducing agent, in such a way that the pump 4 delivers the desired setpoint quantity of reducing agent from the tank 1 to a dispensing point, in particular to a catalytic converter. In addition, heating elements 10 may also be provided in the space 3, which heating elements 10 are supplied electrically with current, in order to heat the reducing agent 2 or to thaw a frozen reducing agent 2.

Figure 2:
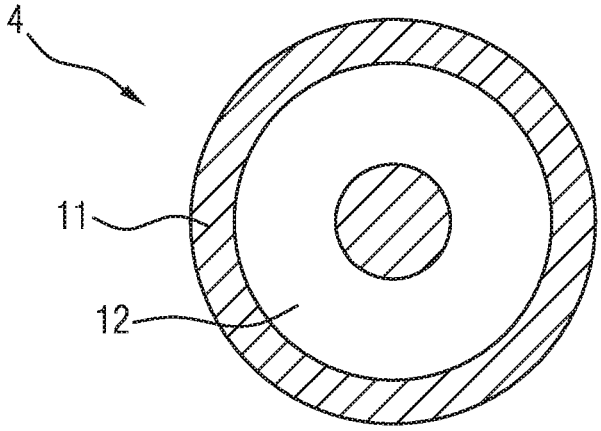
FIG. 2 shows a diagrammatic illustration of a pump with a diaphragm.

FIG. 2 shows a diagrammatic illustration of a part detail of the pump 4, the pump 4 having a housing 11 and a diaphragm 12 which are shown merely diagrammatically. In order to deliver the reducing agent, the diaphragm 12 is moved by the motor 5 in such a way that a fixed setpoint quantity of the reducing agent 2 is transported to a dispensing point.

The pump 4 is configured in such a way that the temperature of the diaphragm 12 influences the actually delivered quantity of the reducing agent 2. The temperature of the diaphragm 12 is influenced by the temperature of the reducing agent 2, by the temperature of the housing 11, and by the temperature of the space 3. In order to estimate the temperature of the diaphragm 12, the temperature of the fluid and/or the temperature of the space 3 are/is taken into consideration.

In one embodiment, the temperature of the fluid 2 in the tank is detected by the control unit 8 with the aid of the first sensor 6. Tables, characteristic curves or calculation processes, by way of which the temperature of the diaphragm may be estimated in a manner which is dependent on the temperature of the fluid, are stored in the data memory 9.

In a further embodiment, in order to estimate the temperature of the diaphragm 12, the control unit 8 additionally also takes the temperature in the space 3 into consideration, which temperature is detected with the aid of the second sensor 7. Characteristic curves, diagrams, characteristic diagrams and/or calculation processes, by way of which the temperature of the diaphragm is estimated in a manner which is dependent on the temperature of the fluid and in a manner which is dependent on the temperature of the space 3, are stored in the data memory 9.

In a further embodiment, in order to estimate the temperature of the diaphragm, the control unit also takes into consideration the setpoint quantity of fluid which the pump 4 delivers in accordance with the actuation by way of the control unit 8, in addition to the temperature of the fluid and to the temperature of the space. Corresponding diagrams, characteristic curves and/or calculation processes are also stored in the data memory to this end, in order for it to be possible to estimate the temperature of the diaphragm in a manner which is dependent on the setpoint quantity of the fluid.

In a further embodiment, the control unit 8 takes the temperature of the housing 11 of the pump 4 into consideration, in order for it to be possible to estimate the temperature of the diaphragm 12. Corresponding characteristic curves, diagrams and/or calculation processes are stored in the data memory 9 to this end.

In a further embodiment, the control unit 8 additionally takes the quantity of heat which is generated by the motor 5 into consideration, in order for it to be possible to estimate the temperature of the diaphragm 12. Characteristic curves and/or characteristic diagrams, by way of which an estimation of the temperature of the diaphragm takes place, are stored to this end in a manner which is dependent on the actuating parameters of the motor.

Furthermore, the control unit 8 may be configured to correct the setpoint quantity of fluid which is delivered by the pump 4, in a manner which is dependent on the estimated temperature of the diaphragm 12. Characteristic curves, diagrams and/or calculation processes, by way of which a setpoint quantity which is delivered by the pump 4 may be corrected to the actually delivered quantity of fluid in a manner which is dependent on the temperature of the diaphragm 12, are stored in the data memory 9 to this end.

Figure 3:
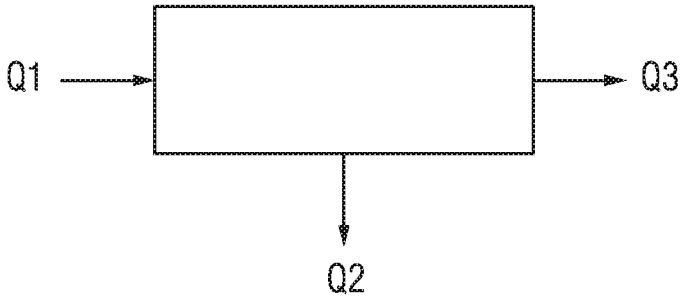
FIG. 3 shows a diagrammatic illustration of a thermal model for the housing of the pump.

FIG. 3 shows a diagrammatic illustration of a heat flow for the housing 11 of the pump 4. A first heat flow Q1 occurs between the housing 11 and the diaphragm 12. A second heat flow Q2 occurs between the housing 11 and the space 3. An overall heat flow Q3 for the housing 11 results from the difference between Q1 and Q2. The second heat flow Q2 may be calculated according to the following formula: $Q2=\alpha\cdot A\cdot(T_C-T_D)$, a describing the heat transfer coefficient, A describing the area, $T_C$ describing the temperature of the housing 11, and $T_D$ describing the temperature of the space 3.

The first heat flow Q1 may be calculated according to the following formula: $Q1=\alpha\cdot A\cdot(T_C-T_M)$, a denoting the heat transfer coefficient, A denoting the area, $T_C$ denoting the temperature of the housing 11, and $T_M$ denoting the temperature of the diaphragm 12.

The third heat flow Q3 is an overall heat flow for the housing 11 and is calculated according to the following formula: $Q3=Q2-Q1$.

The temperature $T_C$ of the housing 11 may be calculated according to the following formula: $T_C=Ti\pm\int(Q3/C_C)\cdot dt$, Ti denoting a predefined initial temperature, t denoting the time, and $C_C$ denoting the heat capacity of the housing 11.

In order to determine the temperature of the diaphragm, a temperature model is used which takes a temperature equalization into consideration. The temperature of the diaphragm is identified in every state by a heat balance during the operation or during the downtime of the pump. The temperature model is applied using temperature differences between the housing, the space, the fluid and the diaphragm. The temperature model calculates a mean temperature between the housing, the space, the fluid and the diaphragm if they have different temperatures.

In order to calculate the temperature of the housing, the temperature difference between the space and the housing and between the diaphragm and the housing is taken into consideration. The temperature difference is responsible for a temperature change of the housing.

A further temperature change of the temperature of the diaphragm 12 is produced by way of the fluid which is pumped by the pump 4, that is to say by the diaphragm 12. It is assumed here in one simple embodiment that, when it reaches the diaphragm 12, the fluid is still at the temperature that the fluid had in the tank 1. Viewed more precisely, it is taken into consideration that the fluid has lost or gained heat on the path from the tank 1 to the diaphragm 12. This information is essential if the fluid, in particular the reducing agent, is at a very low temperature, for example close to 0° C.

The following formula may be used to calculate the temperature of the fluid at the diaphragm 12:

$T_F=\alpha\cdot A\cdot(T_D-T_F)\cdot f(V)$, $\alpha$ denoting the heat transfer coefficient, A denoting the area, $T_D$ denoting the temperature of the space, $T_F$ denoting the temperature of the fluid in the tank 1, and f(V) denoting a function dependent on the volumetric flow of the fluid which is delivered by the pump 4.

The actuation of the motor 5 makes a further contribution of heat. The temperature of the diaphragm 12 may be influenced by the actuation of the motor 5, since frictional heat is produced during the actuation of the motor 5. The generation of heat by way of the motor 5 may be estimated by way of the following formula:

$Q4=E\cdot\eta-F_P$, $F_P$ denoting the fluid pump energy, E denoting the electric power of the motor, and n denoting the degree of efficiency. The electric power E may be calculated by way of the following formula: E=voltage·current. A mean current value may be used as a value for the current.

The fluid pump energy $F_P$ may be calculated according to the following formula: $F_P=(P_F-P_A)\cdot V$, $P_F$ denoting the pressure downstream of the pump, $P_A$ denoting the pressure upstream of the pump, and V denoting the volumetric flow of the pump.

Figure 4:
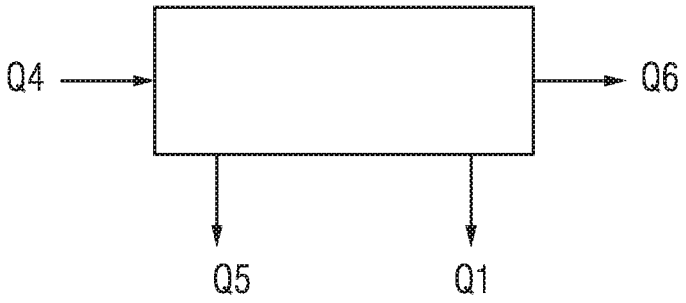
FIG. 4 shows a diagrammatic illustration of a thermal model for the diaphragm.

FIG. 4 shows a diagrammatic illustration of a heat flow of the diaphragm 12. In order to calculate the heat flow on the diaphragm 12, for example, the temperature differences between the temperature of the fluid and the temperature of the diaphragm are taken into consideration. In addition, the temperature difference between the temperature of the housing and the temperature of the diaphragm may be taken into consideration. Furthermore, the heating of the diaphragm on account of the operation of the motor may be taken into consideration. The heat flows are substantially responsible for a temperature change of the diaphragm 12 in the pump 4.

Q5 defines the heat flow between the diaphragm and the fluid and is calculated according to the following formula: $Q5=\alpha\cdot A\cdot(T_M-T_A)$, $\alpha$ describing the heat transfer coefficient, A describing the area, $T_M$ describing the temperature of the diaphragm, and $T_A$ describing the temperature of the fluid. Q4 describes the heat flow as a result of the friction of the motor. Q6 represents the entire heat flow of the diaphragm, it being possible for Q6 to be calculated according to the following formula: Q6=Q4−Q5−Q1.

The temperature of the diaphragm $T_M$ may be calculated according to the following formula: $T_M=T_i\pm\int(Q6/C_M)\,dt$, $T_i$ denoting a start temperature and $C_M$ denoting the heat capacity of the diaphragm.

One advantage of the methods which are described consists in that no additional sensor is required for determining the temperature of the diaphragm. In addition, the estimated temperature of the diaphragm may be used to correct the quantity of fluid dispensed by the pump. Corresponding characteristic curves, diagrams and/or formulae are stored in the data memory 9 to this end.

Figure 5:
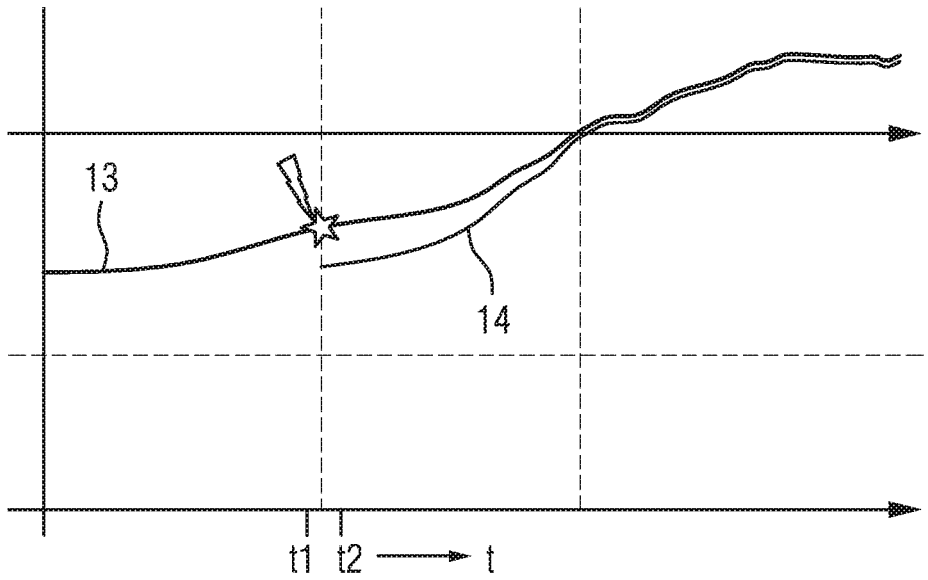
FIG. 5 shows a diagram for a temperature profile of a diaphragm in the case of a brief stop of the pump.

FIG. 5 shows in a diagrammatic illustration of a diagram the temporal profile of the temperature 13 of the diaphragm 12. The temperature 13 is that temperature of the diaphragm 12 of the pump 4 which is estimated according to the method which is described. Between a time t1 and t2, the internal combustion engine is switched off for a predefined, brief time, and the pump 4 is also not driven for a predefined short time (t2−t1) as a result. A short time is understood to mean, for example, from 5 to 10 minutes. After the start of the pump at the second time t2, the temperature which was most recently estimated at the time t1 and was stored in the data memory 9 is used as start temperature $T_i$ for the temperature of the diaphragm. In addition, FIG. 5 shows the temperature 14 of the space 3. The temperature 14 is detected with the aid of the second sensor 7. It is seen here that the temperature 13 of the diaphragm 12 lies considerably above the temperature 14 of the space 3.

Figure 6:
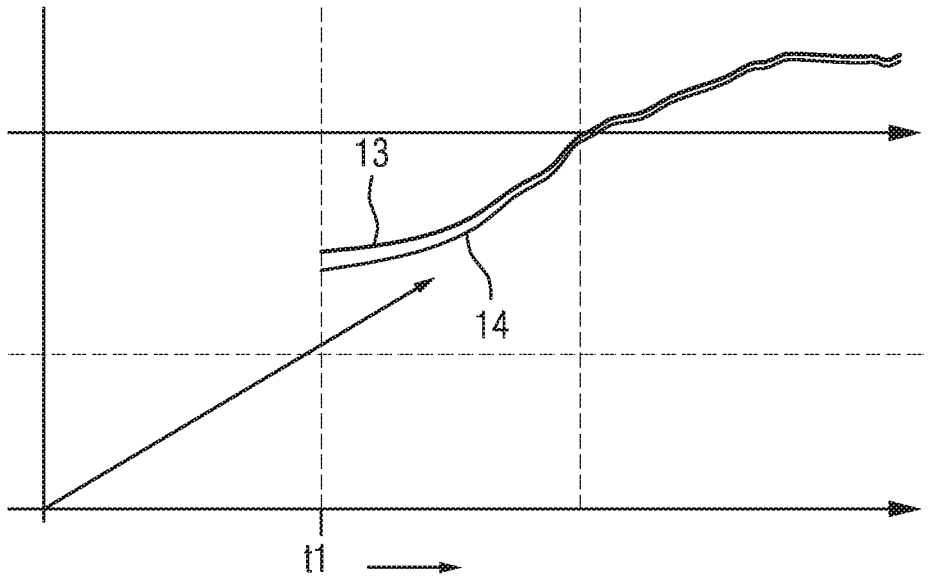
FIG. 6 shows a diagram for a temperature profile of the diaphragm in the case of a relatively long stop of the pump.

FIG. 6 shows a diagrammatic illustration of the temperature 13 of the diaphragm and the temperature 14 of the space after a relatively long pause of the pump 4 at a first time t1. In this case, the pump 4 has not been actuated for a relatively long time period, with the result that the temperature 13 of the diaphragm corresponds approximately to the temperature of the space 3 in accordance with empirical values. A relatively long time period is understood to mean 15 minutes or longer. Therefore, in the case of a start of the pump 4 after a relatively long time period at the first time t1, the temperature 13 of the diaphragm may be set to be equal to the temperature 14 of the space 3 as start value $T_i$.

There is a more precise estimation of the temperature of the diaphragm with the aid of the methods which are described using FIGS. 5 and 6. This affords the advantage that a more precise estimation of the temperature of the diaphragm 12 is possible more rapidly after a start of the pump 4, and a more precise correction of the quantity of fluid which is actually delivered by the pump 4 is also possible more rapidly as a result. In this way, a more rapid and improved estimation of the temperature and therefore a more rapid and improved correction of the quantity of fluid which is delivered by the pump 4, in particular of reducing agent 2, is carried out.

The corrected value for the quantity of fluid which is actually delivered by the pump 4 is used to adapt the actuation of the pump 4 in a corresponding manner, with the result that the desired setpoint quantity is actually delivered. In addition, the corrected quantity of fluid is used to adapt an operating parameter of the combustion of the internal combustion engine in such a way that a desired reduction of exhaust gases in the catalytic converter is achieved.

In addition, the temperature of the diaphragm may be used to carry out a diagnosis in accordance with OBD2, in order to check a correct method of operation of the pump. In particular, a hole in the pump system on the outlet side of the pump may be detected.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A method for determining a temperature of a diaphragm of a pump, comprising:

providing a tank;

providing a pump fastened to the tank;

providing a diaphragm, the diaphragm being part of the pump;

providing a dispensing point in fluid communication with the pump;

using the pump to pump a fluid out of the tank to the dispensing point by way of movement of the diaphragm; and estimating the temperature of the diaphragm in a manner which is at least dependent on the temperature of the fluid in the tank, providing a space which is at least adjacent to the tank; and arranging the pump in the space;

wherein estimating the temperature of the diaphragm is performed in a manner which is dependent on the temperature in the space;

wherein estimating the temperature of the diaphragm is performed during a start of the pump in a manner which is dependent on a duration of a downtime by way of different start values; and wherein the method further comprises fixing the temperature of the diaphragm during the start to a stored value in the case of a brief downtime; and fixing the temperature of the diaphragm, after a relatively long downtime, in a manner which is dependent on the temperature of the space in which the pump is arranged, in particular being set at the same level as the temperature of the space.

2. The method of claim 1, further comprising:

providing a housing, the housing being part of the pump, wherein estimating the temperature of the diaphragm is performed in a manner which is dependent on the temperature of the housing of the pump.

3. The method of claim 1, wherein after the relatively long downtime, the temperature of the diaphragm is set at the same level as the temperature of the space.

4. The method of claim 3, wherein the brief downtime is less than a first time duration, and the relatively long downtime is greater than the first time duration.

5. The method of claim 1, wherein estimating the temperature of the diaphragm is performed in a manner which is dependent on a quantity of fluid which is delivered by the pump.

6. The method of claim 1, further comprising providing a drive, the diaphragm being actuated by the drive, wherein estimating the temperature of the diaphragm is performed in a manner which is dependent on a generation of heat of the drive.

7. The method of claim 1, further comprising providing the fluid to be a reducing agent for a catalytic converter.

8. The method as claimed in claim 7, further comprising arranging the catalytic converter in an exhaust gas section of an internal combustion engine.

9. The method of claim 1, further comprising using the estimated temperature of the diaphragm in order to correct a quantity of fluid which is dispensed by the pump.

10. The method of claim 1, further comprising:

providing a control unit for controlling the operation of the pump; and detecting the temperature of the fluid in the tank using the control unit.

11. A pump system, comprising:

a tank for storing a fluid, the tank including a tank temperature sensor for measuring a temperature of fluid in the tank;

a pump in fluid communication with the tank and including a diaphragm, the pump delivering fluid from the pump through actuation of the diaphragm; and a control unit operably associated with the pump and the tank temperature sensor, the control unit configured to estimate a temperature of the diaphragm based at least upon the measured temperature of the fluid in the tank, wherein the control unit estimates the temperature of the diaphragm during a start of the pump based at least partly upon an amount of downtime of the pump, and wherein if the downtime is less than a first duration amount, the control unit sets the temperature of the diaphragm during the start to a most recent temperature estimate of the diaphragm, and if the downtime is greater than the first duration amount, the control unit sets the temperature of the diaphragm during the start to a temperature of a space in which the pump is disposed.

12. The pump system of claim 11, wherein the pump includes a housing and the control unit estimates the temperature of the diaphragm based at least upon a temperature of the housing.

13. The pump system of claim 11, wherein the pump is disposed in a space adjacent to the tank, the pump system further comprises a temperature sensor disposed in the space and coupled to the control unit, and the control unit estimates the temperature of the diaphragm based at least upon a temperature of the space.

14. The pump system of claim 11, further comprising a motor operably coupled to the pump and to the control unit, wherein the control unit estimates the temperature of the diaphragm based upon at least one of an actuation of the motor and an amount of heat generated thereby.

15. The pump system of claim 11, wherein the control unit estimates the temperature of the diaphragm based upon an amount of fluid delivered by the pump.

16. The pump system of claim 11, wherein the control unit corrects a quantity of fluid delivered by the pump.

* * * * *